United States Patent [19]

Bloomfield et al.

[11] 4,384,689

[45] May 24, 1983

[54] CROSS WOUND YARN PACKAGE

[75] Inventors: Allen A. Bloomfield; James R. Goodall, both of Harrogate, England

[73] Assignee: Imperial Chemical Industries, Ltd., England

[21] Appl. No.: 248,643

[22] Filed: Mar. 27, 1981

[30] Foreign Application Priority Data

Apr. 2, 1980 [GB] United Kingdom ..... 8011073

[51] Int. Cl.[3] ..... B65H 55/00

[52] U.S. Cl. ..... 242/165; 242/18 EW; 242/43 R; 242/43.2

[58] Field of Search ..... 242/18 EW, 18 PW, 18 R, 242/41, 43 R, 43.2, 35.5 A, 164, 165

[56] References Cited

U.S. PATENT DOCUMENTS

| | | | |
|---|---|---|---|
| 868,013 | 10/1907 | Rivett et al. | 242/43.2 |
| 892,783 | 7/1908 | Walder | 242/41 X |
| 1,267,913 | 5/1918 | Seifert | 242/41 |
| 1,928,365 | 9/1933 | Anderson | 242/43.2 |
| 2,221,999 | 11/1940 | Reiners et al. | 242/18 PW X |
| 4,138,072 | 2/1979 | Aoyama et al. | 242/18 EW X |

FOREIGN PATENT DOCUMENTS

| | | | |
|---|---|---|---|
| 181838 | 3/1907 | Fed. Rep. of Germany . | |
| 296203 | 1/1917 | Fed. Rep. of Germany . | |
| 537733 | 11/1931 | Fed. Rep. of Germany . | |
| 2312446 | 12/1976 | France . | |
| 874651 | 8/1961 | United Kingdom | 242/43.2 |

*Primary Examiner*—Stanley N. Gilreath
*Attorney, Agent, or Firm*—Roderick B. Macleod

[57] ABSTRACT

The invention comprises (a) an improved cross wound yarn package on which the final few turns of yarn are wound as a compact pile wound bunch on the cylindrical cross wound package surface; (b) apparatus for winding such a package, comprising a fixed pile winding guide (4 in FIG. 3) as well as a traverse guide (1 in FIG. 3) and means effective to move the yarn from one to the other (5 in FIG. 3); and (c) a modified yarn traverse roll with an extra circumferential groove to aid pile winding (2 in FIG. 1) intersecting a helical traverse groove (1 in FIG. 1).

3 Claims, 7 Drawing Figures

CROSS WOUND YARN PACKAGE

This invention relates to improved cross wound flat filament yarn packages and means for their production. The trailing yarn end on the outside of such a package is very prone to accidental unwinding. This is particularly so during doffing from a high speed winding machine in which the package is surface driven because windage due to the driven rolls tends to unwind the trailing end as the package slows down and comes to rest.

We have surprisingly found that the trailing end of a cross wound package of flat filament yarn can be rendered adequately resistant to accidental unwinding, and yet at the same time adequately responsive to deliberate unwinding, by winding the last few turns of yarn in a compact pile wound bunch at substantially zero helix angle on the cylindrical surface of the cross wound package. The stability of such a bunch can readily be assessed by holding a cross wound package with its axis horizontal and its trailing yarn end hanging free, and slowly rotating the package while pulling on the free end to unwind it so that it continues to hang from the underside of the package. A stage is reached when the freely hanging end of yarn is heavy enough to unwind itself on rotation of the package without further need to pull it. Typically this starts to happen with less than 10 cm of yarn end freely hanging from a cross wound package surface, but when a compact bunch of at least twenty turns of yarn is pile wound at zero traverse angle on the cylindrical cross wound package surface the length of yarn end freely hanging from it which is needed to cause spontaneous unwinding on further rotation of the bobbin typically rises to over 100 cm, typically over 200 cm. The coherency, C, of the bunch may be defined conveniently as the minimum number of centimeters of freely hanging yarn which will cause such spontaneous unwinding. If the bunch has a coherency of less than 100 cm it provides insufficient resistance to accidental unwinding due to windage or other forces during doffing and subsequent handling. If the coherency of the bunch is too high then it will not unwind satisfactorily to feed yarn into a subsequent process, and then it must be stripped off before the bobbin is used as a practical yarn supply package. For this reason we prefer the unwinding tension, T, of the coherent bunch to be less than 0.5 g/dtex.

We prefer a compacted wound bunch of at least twenty turns and even more preferably at least fifty turns. If the tail is very long the coherency does not go on rising but the pressure due to the yarn tension or the drive roll or baling roll on the package surface during winding becomes sufficiently concentrated on the growing pile wound bunch to cause yarn damage during winding or tension snatching and filamentation during unwinding, or both. To avoid damage and retain adequate unwindability, we prefer less than 1000 turns and less than five hundred turns are even more preferable. We find one hundred to five hundred turns convenient to make but the shortest tail consistent with adequate coherence is the best.

During pile winding the yarn tension or the pressure of a surface drive or baling roll naturally causes some yarn displacement: a pile wound tail of 130 decitex flat multi filament yarn typically becomes at least a millimeter wide when more than one hundred turns are wound. The yarn is therefore inevitably wound at small and randomly fluctuating angles to the circumference, around a mean angle of zero. This is acceptable; but if a residual true traverse helix angle of as much as one degree is permitted the coherency of the tail is reduced.

The centrifugal force on the yarn end, after cutting the yarn and before the package comes to rest, detaches it sufficiently from the rest of the pile wound bunch so that it can readily be found, but the coherence of a bunch according to the invention adequately suppresses accidental unwinding of the free end.

In order to make a bunch according to the invention the yarn traverse must be suppressed so that the yarn is allowed to pile wind for a short controlled interval before doffing. When the yarn traverse is caused by a single traverse mechanism such as a reciprocating guide or a helically grooved roll, a tail according to the invention can be formed by lifting the yarn from the traverse means and engaging it in a fixed pile winding guide for a short controlled interval. The fixed pile winding guide is positioned conveniently close to, and between the extremes of, the traverse guide stroke in order to facilitate yarn transfer and so that the resultant pile wound yarn bunch is positioned between the ends of the cross wound yarn package. Any convenient mechanism may be used to effect this yarn transfer, one convenient mechanism comprising a yarn deflector guide movable along a line parallel with the winding spindle axis and profiled so that when it enters the triangle defined by the limits of the traverse stroke and the fixed feed guide, it lifts the yarn out of the traverse means near the limit of its stroke and deflects it into the fixed pile winding guide. Alternatives are to use a positively deflected instead of merely profiled deflector guide, or to move the pile winding guide itself into the yarn traversing triangle to intercept the yarn, or to transfer the yarn from the traverse means to the pile winding guide by a momentary pneumatic impulse.

After a controlled interval in the pile winding guide, the package may be doffed by any known procedure which may involve either cutting the advancing yarn and entraining it in as aspirator as for example described in U.K. Pat. No. 1,534,951, or transferring the advancing yarn directly from a full bobbin to an empty one as for example described in U.K. Pat. No. 1,294,752.

When the yarn traverse is caused by a reciprocating traverse guide supplemented by a grooved traverse roll it is not enough to lift the yarn out of the traverse guide because the grooved roll often causes a significant degree of yarn flutter, sometimes traversing it between adjacent groove cross over points. We have discovered that traversing can be completely suppressed in such winders, so that a windage resistant pile wound bunch according to the invention can be produced, if a circumferential groove is provided in the traverse roll. This need not be cut round the whole circumference: an arc of even less than 180° can be sufficient. The pile winding guide must of course be positioned in the plane defined by the circumferential groove.

The circumferential groove has merely to be effective in preventing the yarn from being deflected by the helical traverse groove, and in keeping it in pile winding mode as it advances from a fixed guide on to the package surface. The conditions for achieving this depend on the circumstances. For instance if a high modulus yarn is being wound under low tension as it issues from a constant speed godet positioned close to the winder, then the circumferential pile winding yarn path length should not be significantly less than the helical traversing yarn path length, because the corresponding drop in yarn tension could easily be sufficient to cause enough yarn flutter to produce a bad bunch. A deep 360° groove would therefore not be preferred because there would be too much reduction in path length on going from helical to pile winding mode: but too shallow and short a groove could fail to be consistent enough in yarn entrainment even though it prevented loss of tension. Under such circumstances we prefer a circumferential groove with a depth slightly less than the helical groove depth and we also prefer that the circumferential groove is cut through a cross over point in the helical traverse groove. The symmetry of this arrangement and the avoidance of two separate groove intersections round the circumference improve consistency of operation. It is also helpful to provide a flattened nose between the crossing helical grooves to facilitate entry into the circumferential groove. We also prefer the groove to have an arc length substantially less than 360° so that the yarn tension is maintained in the pile wound mode by running the yarn over part of the traverse roll at its full diameter.

However, when, in an opposite extreme circumstance, a relatively low modulus melt spun yarn is being wound up without a godet from a distant spinneret, none of these considerations is nearly so critical because yarn tension is not so sensitive to the change in path length between helical and pile winding modes, and a wider range of groove designs is therefore acceptably workable.

In the accompanying drawings.

Figure 4:
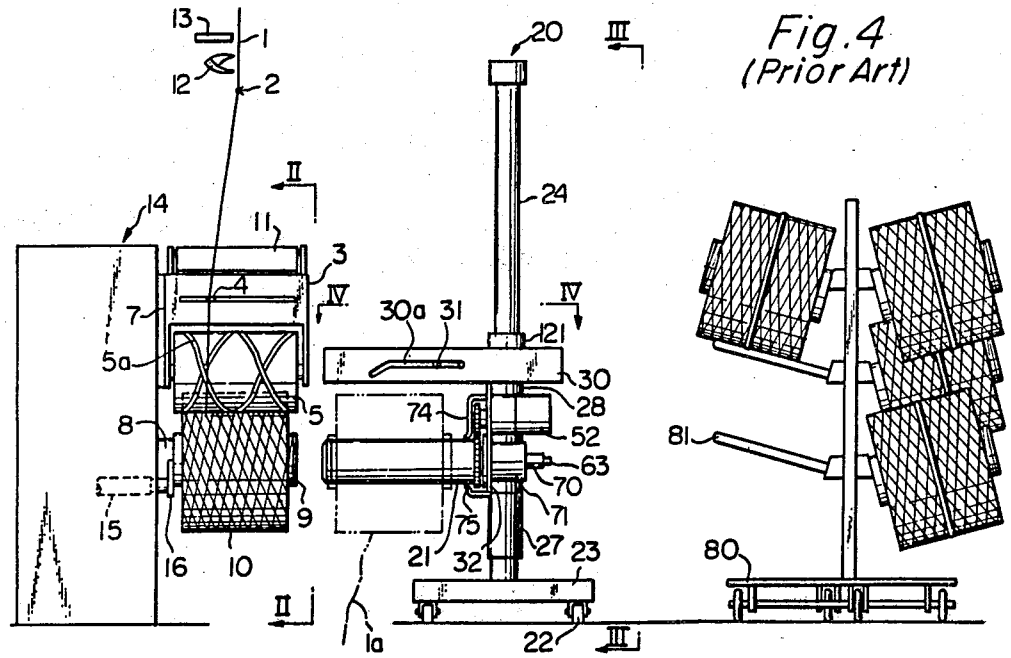
Fig. 4 (Prior Art)
Figure 6:
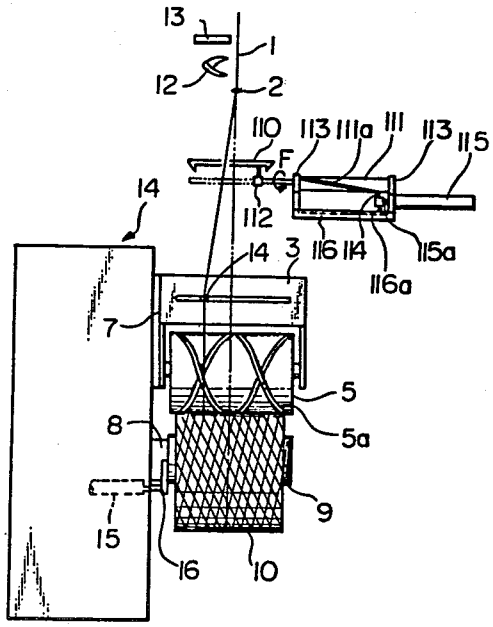
Fig. 6 (Prior Art)
Figure 5:
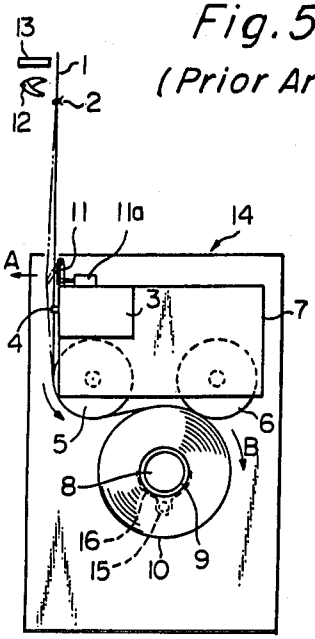
Fig. 5 (Prior Art)
Figure 7:
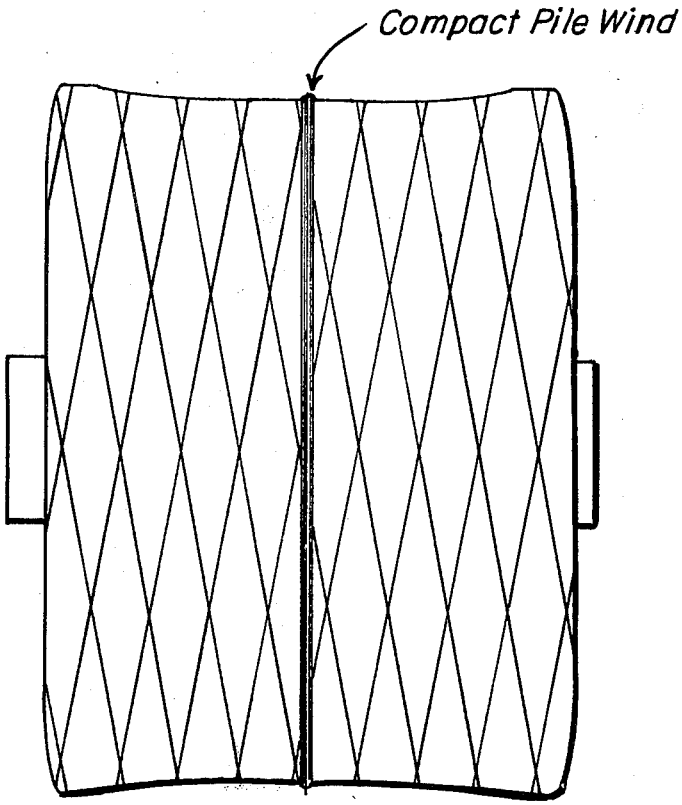

FIG. 4 is an elevational view of prior art apparatus and yarn packages as shown in U.S. Pat. No. 4,138,072, including (i) apparatus for winding melt-spun yarn in the form of first full packages of crosswound yarn on tubes, each package having at least one bunch turn around the crosswound yarn and an end of yarn trailing from the bunch turn, (ii) separate apparatus for receiving the first package and rewinding the trailing end to form a second package, and (iii) second packages thereby obtained mounted on a package truck;

FIG. 5 is a side view taken in the direction II—II of FIG. 4;

FIG. 6 is an elevation view of the prior art yarn release guide mounted on doffing apparatus, for forming a bunch turn around a crosswound package; and FIG. 7 is an elevation view of a package of the invention.

Figure 1:
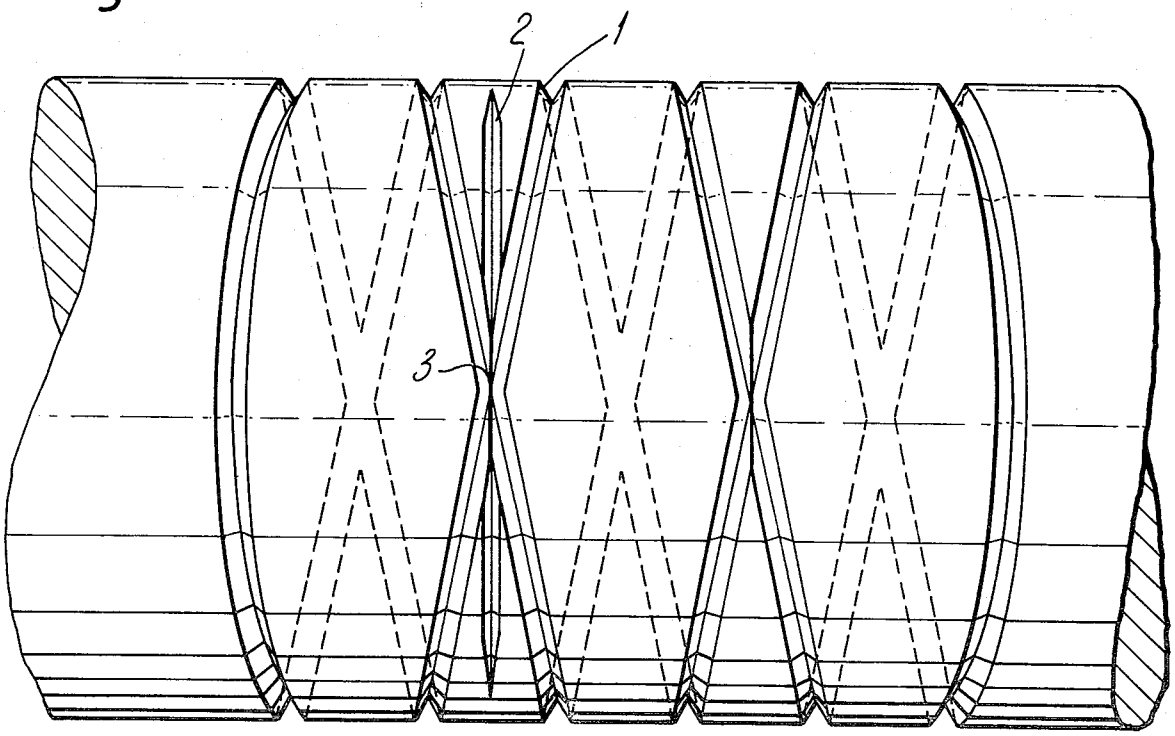
FIGS. 1 and 2 are plan views of parts of a grooved traverse roll of a multi-cop winder, each part including a full helical traverse groove and a circumferential groove according to the invention.

In FIG. 1 an arc of circumferential groove 2 extending about 170° round the traverse roll is cut to intersect a cross over point 3 in a helical traverse groove 1.

Figure 2:
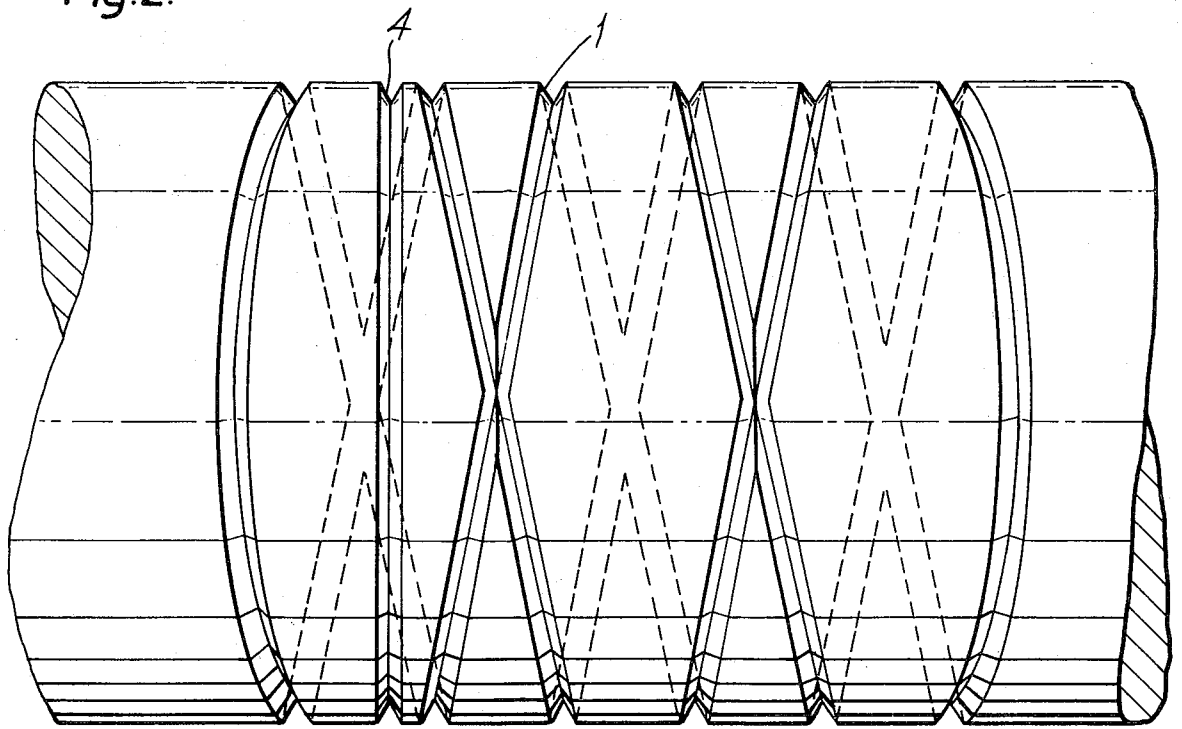

In FIG. 2 a full circumferential groove 4 is cut in a position not to intersect a cross over point in traverse groove 1.

The full circumferential groove 4 intersects the traverse groove twice, increasing the danger of yarn flutter causing re-entrainment into the traverse groove. The arc of circumferential groove 2 intersects the traverse groove only once, and the associated circumferential yarn path round the traverse roll at its full diameter does not intersect the traverse groove at all. This provides less opportunity for accidental re-entrainment in the traverse groove and maximum circumferential yarn path length and is therefore the preferred arrangement.

Figure 3:
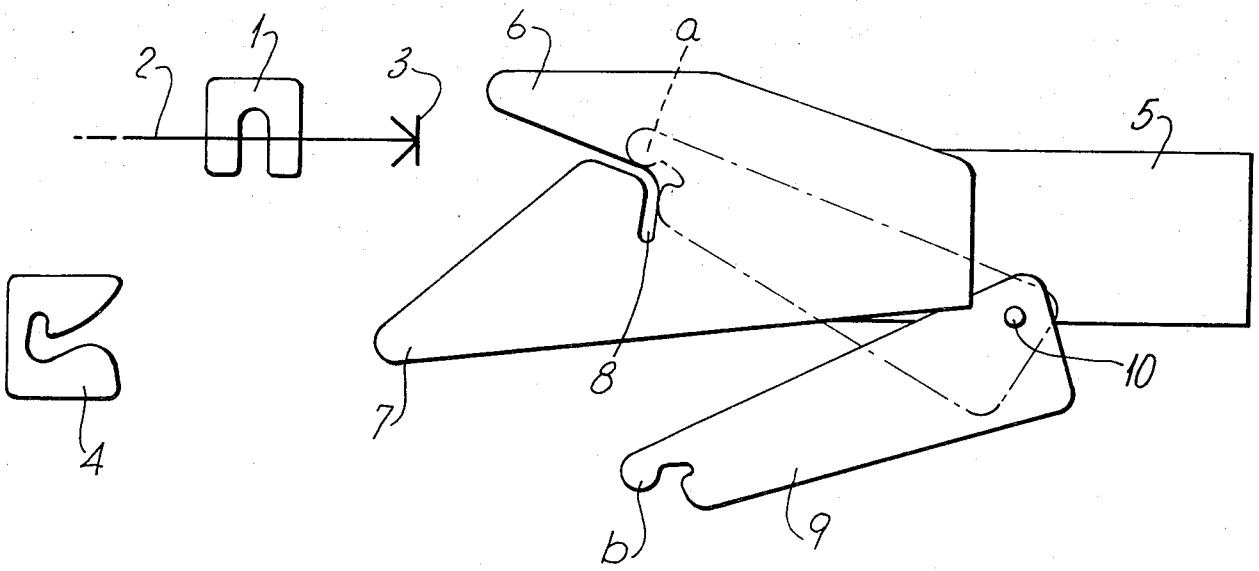
FIG. 3 is a semi-schematic plan view of a convenient mechanism for moving a yarn from a traverse guide to a fixed pile winding guide so that it leaves the helical traverse groove and engages in the circumferential groove.

Turning to FIG. 3, a yarn traverse guide 1 has a stroke along line 2 with a right hand limit at point 3 and guide 4 is a fixed pile winding guide. A deflector guide 5 is moveable along a line parallel to line 2 but in front of it so that as it moves to the left collecting jaws 6 and 7, which are rigidly attached to it, embrace the path of a yarn which is advancing through traverse guide 1 in a plane substantially perpendicular to the drawing. As the deflector guide advances, the profile of jaw 6 lifts the yarn from the traverse guide 1 into the blind slot 8. A flipper 9 rotatably mounted on a pin 10 in member 5 is then moved by piston means not shown from position a to position b. As the deflector guide continues to advance to the left the yarn advancing through flipper 9 in position b engages in pile winding guide 4. The deflector guide 5 can conveniently be mounted on known yarn cutter and aspirator apparatus not shown. Control of the pile winding time is readily effected by using known sensors and timing devices not shown, providing for example a timed interval between the time when the deflector guide assembly reaches the position where the yarn is engaged in guide 4 and the time when the yarn cutter is actuated.

A Barmag SW46SSD winding machine with a helical traverse groove depth varying from 4 to 5 mm between traverse centre and traverse end was modified with extra circumferential grooves of different kinds. The consistency of successful production of a tail according to the invention by each kind of added groove is indicated in general qualitative terms in the table in two different process circumstances.

| Circumferential Groove | Drawn 50 dtex flat interlaced polyester yarn received from a godet at 3650 mpm | Partially drawn 131 dtex flat interlaced polyester yarn received direct from a spinneret at 3000 mpm |
|---|---|---|
| 1. 3 mm groove away from cross over | Very inconsistent | Not entirely consistent |
| 2. 3 mm groove at cross over | Not consistent | Consistent |
| 3. 0.75 mm groove away from cross over | Not consistent | Not entirely consistent |
| 4. 0.75 mm groove at cross over | Consistent | Consistent |
| 5. 0.25 mm groove at cross over | Very inconsistent | Very inconsistent |
| 6. 1 mm groove at cross over | Consistent | Consistent |
| 7. 60° arc of 2 mm groove falling to zero at groove ends and rising to 3 mm at the groove centre, which intersects the traverse groove at a cross over | Consistent | Consistent |

These experimental comparisons with two kinds of yarn and feed arrangement and one type of winder illustrate the selection of appropriate circumferential groove geometry. Different machine and process details will lead to different optima of circumferential groove design; and detailed optimisation of the geometry of the leading or yarn entry end of the circumferential groove where it opens into or crosses the helical groove will improve consistency of operation in otherwise marginal cases. Optimum groove designs may also depend on other differences between kinds of flat yarns; whether for instance the filaments are more parallel as in non-interlaced yarns, or less parallel as in textured yarns held taught under the winding tension.

In one practical use of the invention, winding 50 dtex flat interlaced polyester yarns at 3670 mpm on Barmag SW46SSD machines modified with full circumferential grooves in the traverse rolls which were 1.8 mm deep and ceramic coated and intersected the traverse grooves at the central cross over points, bobbins were produced which all survived the doffing cycle on the winder without any problem from flying yarn ends, and which all unwound satisfactory on a beam creel. On these bobbins the yarn bunches according to the invention were characterised by unwinding tensions all below 0.1 gram/dtex and coherencies between 2 and 13 meters.

We claim:

1. A cross wound package of flat melt-spun filament yarn characterised by the outer yarn end being pile wound in a compact bunch on the cross wound package surface, and wherein (i) the bunch comprises at least 20 turns; (ii) the coherency, C, of the bunch is at least 100 cm; and (iii) the unwinding tension, T, of the bunch is less than 0.5 g/dtex.

2. A package according to claim 1, wherein the bunch comprises 50 to 500 turns.

3. A package according to claim 1 wherein the pile turns are wound at a true traverse helix angle of less than one degree.

* * * * *